US006890153B2

(12) United States Patent
Demers et al.

(10) Patent No.: US 6,890,153 B2
(45) Date of Patent: May 10, 2005

(54) CASTELLATED TURBINE AIRFOIL

(75) Inventors: Daniel Edward Demers, Ipswich, MA (US); Mohammad Esmaail Taslim, Needham, MA (US)

(73) Assignee: General Electric Company, Schenectady, NY (US)

( * ) Notice: Subject to any disclaimer, the term of this patent is extended or adjusted under 35 U.S.C. 154(b) by 226 days.

(21) Appl. No.: 10/425,262

(22) Filed: Apr. 29, 2003

(65) Prior Publication Data

US 2004/0219016 A1 Nov. 4, 2004

(51) Int. Cl.[7] ..... F01D 5/08

(52) U.S. Cl. ..... 416/97 R; 416/96 R; 415/1; 415/115

(58) Field of Search ..... 416/97 R, 96 R, 416/97 A, 96 A, 92, 95 R; 415/1, 191, 115

(56) References Cited

U.S. PATENT DOCUMENTS

| | | | | |
|---|---|---|---|---|
| 4,180,373 A | | 12/1979 | Moore et al. | |
| 4,416,585 A | | 11/1983 | Abdel-Messeh | |
| 4,515,526 A | * | 5/1985 | Levengood | 416/96 R |
| 4,770,608 A | | 9/1988 | Anderson et al. | |
| 5,232,343 A | | 8/1993 | Butts | |
| 5,472,316 A | | 12/1995 | Taslim et al. | |
| 5,720,431 A | | 2/1998 | Sellers et al. | |
| 6,089,826 A | | 7/2000 | Tomital et al. | |
| 6,116,854 A | * | 9/2000 | Yuri | 416/97 R |

OTHER PUBLICATIONS

Taslim et al, "An Experimental Study of Impingement on Roughened Airfoil Leading–Walls with Film Holes", Oct. 2001, Journal of Turbomachinery, vol. 123,No. 4, pp. 766–773.

Taslim et al, "An Experimental Evaluation of Advanced Leading Edge Impingement Cooling Concepts," Journal of Turbomachinery, 2001, vol. 123, No. 2, pp. 147–153.

* cited by examiner

*Primary Examiner*—Edward K. Look
*Assistant Examiner*—J. M. McAleenan
(74) *Attorney, Agent, or Firm*—William S. Andes; Francis L. Conte

(57) ABSTRACT

A turbine airfoil includes pressure and suction sidewalls joined together at opposite leading and trailing edges, and at a forward bridge spaced behind the leading edge to define a flow channel. The bridge includes a row of impingement holes. The flow channel includes a row of fins behind the leading edge, a row of first turbulators behind the pressure sidewall, and row of second turbulators behind the suction sidewall. The fins and turbulators have different configurations for increasing internal surface area and heat transfer for back side cooling the leading edge by the cooling air.

20 Claims, 3 Drawing Sheets

CASTELLATED TURBINE AIRFOIL

The U.S. Government may have certain rights in this invention in accordance with Contract Number DAAE07-00-C-N086 awarded by the Department of the Army.

BACKGROUND OF THE INVENTION

The present invention relates generally to gas turbine engines, and, more specifically, to turbine airfoil cooling.

In a gas turbine engine, air is pressurized in a compressor and mixed with fuel in a combustor for generating hot combustion gases which flow downstream through several turbine stages. A high pressure turbine (HPT) includes first stage turbine rotor blades extending outwardly from a supporting rotor disk which is rotated by the gases for powering the compressor. A low pressure turbine (LPT) follows the HPT and includes corresponding rotor blades which extract additional energy from the gases for performing useful work such as powering an output drive shaft. In one example, the shaft may be connected to a transmission for powering a military vehicle such as a battle tank.

Since the first stage turbine rotor blades are subject to the hottest combustion gas temperatures, they are cooled using a portion of the pressurized air bled from the compressor. However, any air bled from the compressor correspondingly decreases the overall efficiency of the engine, and therefore should be minimized.

The prior art contains a multitude of patents including various configurations for cooling turbine airfoils found in rotor blades or stator nozzle vanes. Various forms of cooling channels are known and include multi-pass serpentine cooling circuits, dedicated cooling channels for the leading edge or trailing edge of the airfoil, turbulators and pins for enhancing heat transfer by convection cooling, impingement cooling, apertures, and various forms of film cooling holes extending through the pressure and suction sidewalls of the airfoil.

The prior art is replete with different configurations for turbine airfoil cooling in view of the hostile operating environment in a gas turbine engine, and the substantial variation in heat loads from the combustion gases over the pressure and suction sides of the airfoil between the leading and trailing edges and root to tip thereof.

It is desired to maximize the cooling ability of the cooling air, while minimizing the amount of such cooling air diverted from the combustion process. Yet, sufficient air under sufficient pressure must be provided to the airfoils for driving the cooling air therethrough with sufficient pressure while maintaining sufficient backflow margin to prevent ingestion of the combustion gases through the various discharge holes in the airfoils. And, it is common to use the same cooling air for multiple cooling functions in a single turbine airfoil, which additionally increases the complexity of the design since the various cooling functions are then interrelated, with the upstream cooling features affecting the downstream cooling features as the cooling air absorbs heat along its flowpath.

A particularly difficult region of the turbine airfoil to cool is its leading edge along which the hot combustion gases first impinge the airfoil. The leading edge has an arcuate curvature which correspondingly creates more surface area on the external surface of the airfoil than its internal surface directly behind the leading edge in the first or leading edge flow channel located thereat. The leading edge flow channel may have smooth surfaces with impingement cooling thereof through a row of impingement holes in a forward bridge joining the pressure and suction sidewalls.

The spent impingement air is then typically discharged from the leading edge channel through multiple rows of film cooling holes typically arranged in a showerbead along the leading edge for providing external film cooling of the airfoil. Corresponding rows of gill holes may also be used downstream from the leading edge for additionally discharging the spent impingement air from the leading edge channel.

The leading edge channel may be otherwise configured with various forms of turbulators therein which protrude into the flow channel for tripping the cooling air channeled radially outwardly or inwardly depending upon the design.

Furthermore, stationary nozzle vanes may be cooled by channeling compressor bleed air either radially outwardly or inwardly therethrough. And, first stage turbine nozzles typically include impingement baffles suspended therein in yet another configuration for providing enhanced cooling thereof.

Correspondingly, turbine rotor blades receive their cooling air from the radially inner roots of the blades which are mounted around the perimeter of the rotor disk. Since the blades rotate during operation they are subject to substantial centrifugal forces which also affect performance of the cooling air being channeled through the blade airfoils.

Accordingly, it is desired to provide a turbine airfoil having improved internal cooling behind the leading edge thereof.

BRIEF DESCRIPTION OF THE INVENTION

A turbine airfoil includes pressure and suction sidewalls joined together at opposite leading and trailing edges, and at a forward bridge spaced behind the leading edge to define a flow channel. The bridge includes a row of impingement holes. The flow channel includes a row of fins behind the leading edge, a row of first turbulators behind the pressure sidewall, and row of second turbulators behind the suction sidewall. The fins and turbulators have different configurations for increasing internal surface area and heat transfer for back side cooling the leading edge by the cooling air.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
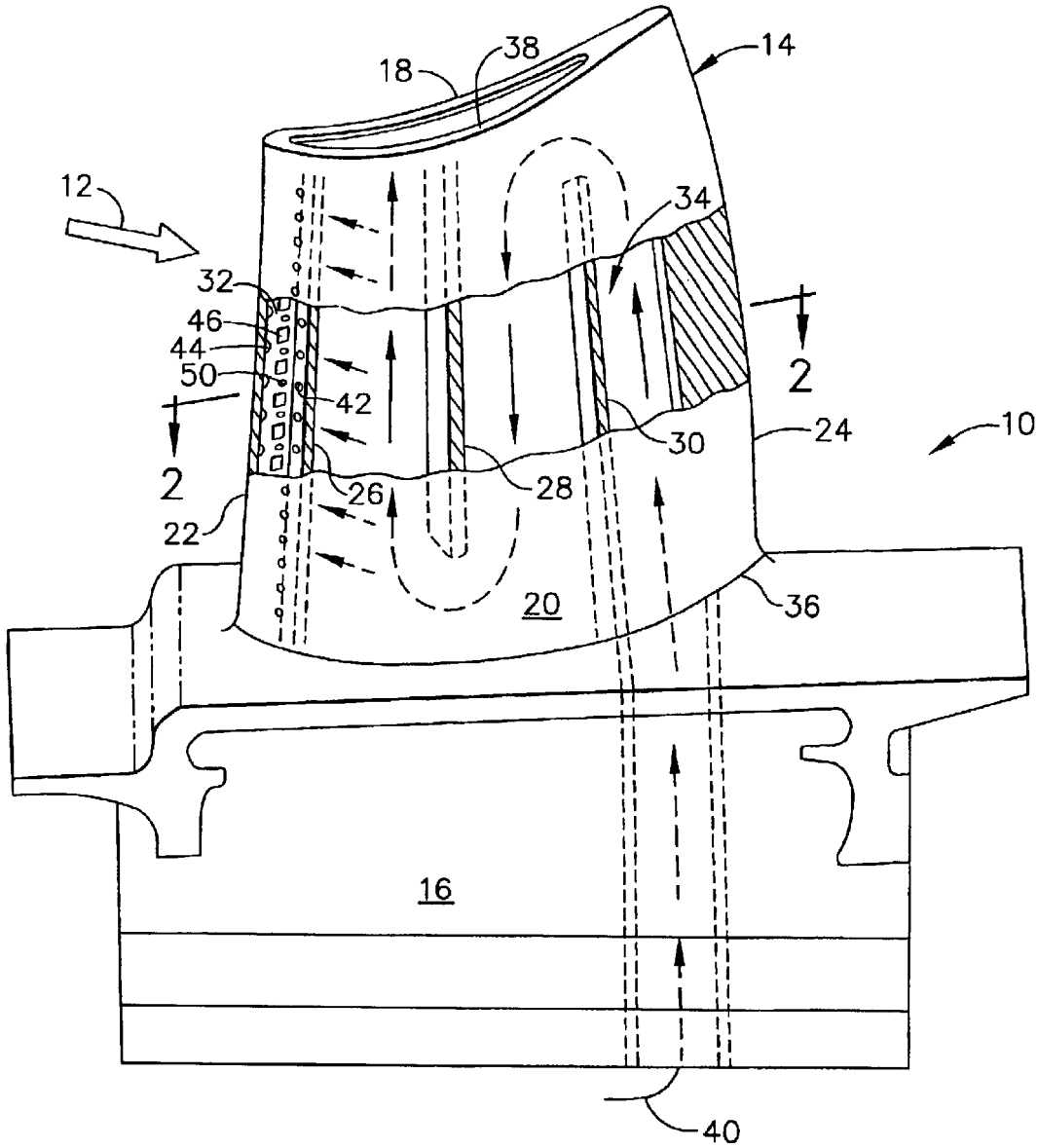
FIG. 1 is an isometric view of an exemplary first stage turbine rotor blade of a gas turbine engine having a cooling circuit configured in accordance with an exemplary embodiment.

Illustrated in FIG. 1 is an exemplary first stage turbine rotor blade 10 for a gas turbine engine which extracts energy from combustion gases 12 discharged from a combustor during operation. The blade includes a hollow airfoil 14 extending radially or longitudinally outwardly from an integral mounting dovetail 16. The blade is typically manufactured by casting in a unitary component.

Figure 2:
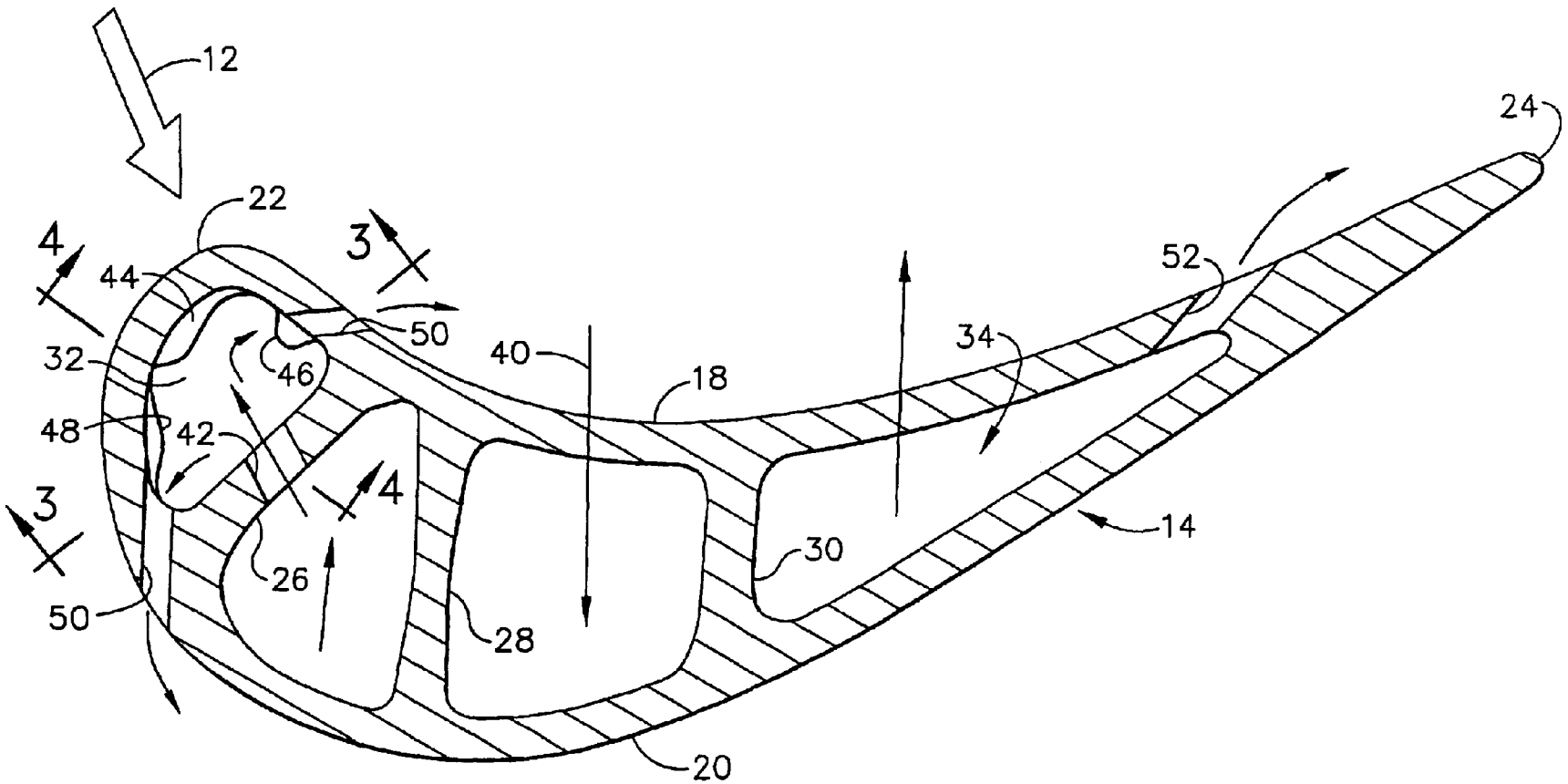
FIG. 2 is a transverse sectional view of the turbine airfoil illustrated in FIG. 1, and taken along line 2—2.

As shown in FIGS. 1 and 2, the airfoil includes a generally concave first or pressure sidewall 18 integrally joined to a circumferentially or laterally opposite, generally convex second or suction sidewall 20 at axially opposite leading and trailing edges 22,24. The two sidewalls are also integrally joined together at a forward bridge 26 spaced behind the leading edge, a midchord bridge 28 spaced therebehind, and an aft bridge 30 spaced between the midchord bridge and the trailing edge of the airfoil.

The multiple bridges define a first or leading edge flow channel 32 extending directly behind the leading edge which is disposed in flow communication with a three-pass serpentine flow circuit 34 commencing in front of the trailing edge. These flow channels extend radially or longitudinally between a root 36 and an opposite tip 38 of the airfoil. The serpentine circuit 34 in this exemplary embodiment includes an inlet channel extending through the dovetail for receiving pressurized cooling air 40 suitably bled from the compressor of the engine, such as compressor discharge air.

The inlet channel of the serpentine circuit extends longitudinally upwardly through the dovetail in front of the trailing edge, and the aft bridge 34 terminates short of the tip for defining a first turning bend. The air is then channeled radially inwardly through the middle channel of the serpentine circuit and turns again at a bend located at the bottom of the midchord bridge 28.

The third or final channel in the serpentine circuit extends radially upwardly between the forward and midchord bridges to feed the cooling air 40 into the leading edge channel. Although the cooling air has initially been heated as it cools the airfoil in the serpentine circuit, it retains residual cooling effectiveness for additionally cooling the leading edge region of the airfoil in accordance with a preferred embodiment.

More specifically, the forward bridge 26 includes a row of impingement or crossover holes 42 extending therethrough for channeling the cooling air 40 into the first channel 32 in impingement against the back side of the leading edge. Since the back side, or internal surface, of the leading edge has less surface area than the external surface of the leading edge due to the arcuate curvature thereof, the first channel includes a row of ridges or fins 44 protruding therein from the back side of the leading edge for increasing surface area for dispersing heat from the airfoil sidewalls.

A row of first turbulators 46 also protrudes into the first flow channel from the back side of the pressure sidewall in cooperation with the fins, and another row of second turbulators 48 additionally protrudes into the first channel from the back side of the suction sidewall.

Figure 3:
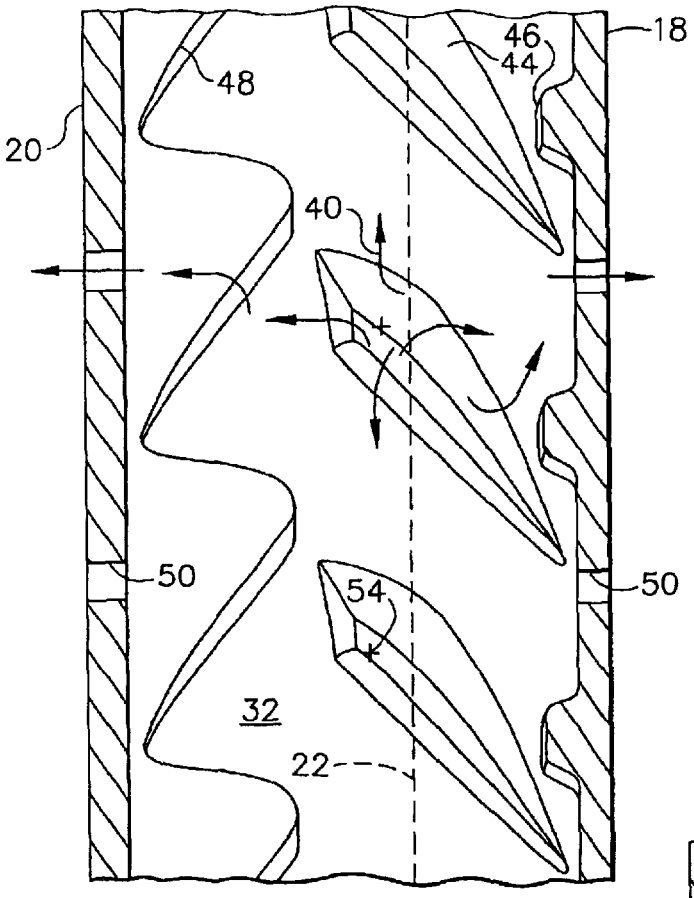
FIG. 3 is a radial or longitudinal sectional view through the leading edge flow channel of the airfoil illustrated in FIG. 2 and taken along line 3—3.
Figure 4:
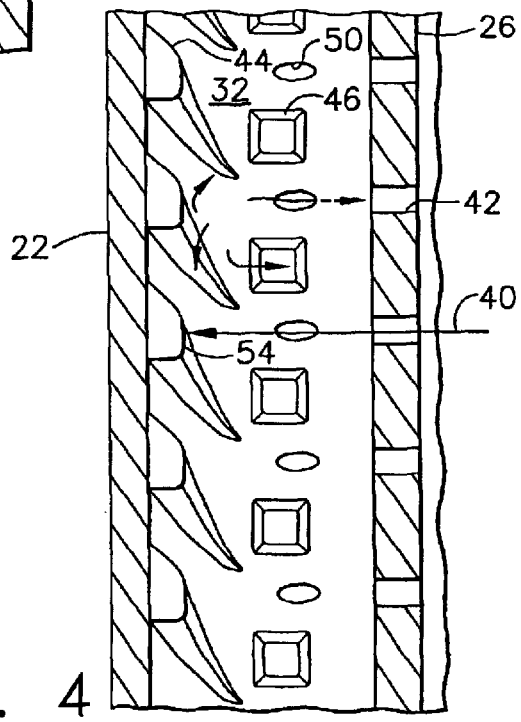
FIG. 4 is a longitudinal sectional view of the leading edge flow channel illustrated in FIG. 2 and taken along line 4—4.

The fins 44 and first and second turbulators 46,48 are additionally illustrated in FIGS. 3 and 4 and have different configurations in castellated or alternating form or shape for increasing the internal surface area and heat transfer for back side cooling the leading edge by the impingement air first received through the impingement holes 42.

As initially shown in FIG. 2, both the pressure and suction sidewalls 18,20 include respective rows of inclined gill holes 50 having corresponding inlets disposed between the leading edge and forward bridge for discharging laterally through external outlets the cooling air from the first channel during operation. Due to the enhanced cooling performance of the cooperating fins and turbulators in the first channel, the gill holes provide the sole outlets for the cooling air from the first channel, and the leading edge is otherwise imperforate between the gill holes.

In this way, the leading edge itself may be devoid of the typical showerhead film cooling holes typically required along the leading edge for providing cooling thereof during operation. Elimination of the showerhead holes along the leading edge correspondingly increases the low cycle fatigue capability since the stress concentration imparted by such holes is avoided. However, showerhead film cooling holes could be used in other embodiments of the invention if desired. Low cycle fatigue of such showerhead holes would then have to be addressed to ensure a suitable useful life of the airfoil.

As also shown in FIG. 2, the airfoil may also include a row of trailing edge discharge holes 52 having inlets in the first leg of the serpentine circuit and external outlets spaced forwardly of the airfoil trailing edge. These trailing edge holes discharge a film of cooling air for cooling the trailing edge region of the airfoil along the pressure sidewall. The pressure and suction sidewalls may otherwise be imperforate, with the cooling air being channeled through the three legs of the serpentine circuit for discharge into the leading edge channel 32 in back side impingement cooling of the leading edge prior to being discharged through the gill holes for providing film cooling of the external surfaces of the airfoil.

As illustrated in FIGS. 3 and 4 each of the fins 44 includes a high spot of preferably maximum height defining a target 54 which is aligned with or corresponds with one of the impingement holes 42 for being impingement cooled by the cooling air discharged therefrom. Each fin 44 then tapers or decreases in height from the target outwardly to its distal perimeter.

In this way, each fin provides increased surface area for not only radiating or dispersing inwardly heat from the leading edge of the airfoil but for being impingement cooled by the air discharged from the corresponding impingement hole 42. The increased surface area due to the fins increases cooling effectiveness, while impingement cooling additionally increases cooling effectiveness from the impingement jet.

Since the leading edge channel 32 is preferably closed at its root and tip ends, the gill holes 50 alone provide the discharge outlets therefrom. Accordingly, after the cooling air impinges each of the corresponding fins 44 it will flow laterally along the pressure and suction sidewalls for discharge through the corresponding rows of gill holes. The first and second turbulators 46,48 are disposed on those opposite sidewalls and are preferably longitudinally or radially offset from respective ones of the fins 44 to provide circuitous discharge routes for the cooling air as it leaves the gill holes.

As shown in FIG. 3, the first and second turbulators are also preferably laterally or circumferentially offset from respective ones of the fins 44 for further increasing the circuitous discharge flowpath of the spent impingement air. Following impingement of the fins 44, the air flows laterally toward the gill holes and then encounters the elevated first and second turbulators 46,48 which trip the air for further enhancing heat transfer effectiveness thereof.

FIGS. 3 and 4 illustrate preferred forms of the fins 44 and first and second turbulators 46,48 which not only have different configurations but different inclinations longitudinally or radially through the leading edge flow channel. For example, each of the fins 44 illustrated in FIG. 3 is inclined downwardly from its high-spot target 54 toward both the airfoil root and forward bridge along the pressure sidewall 18.

Furthermore, each of the fins 44 preferably tapers down or decreases in height from the targets 54 along the pressure sidewall to the forward bridge 26. This tapered configuration cooperates with the different configuration of the pressure-side first turbulators 46 for enhancing heat transfer, as well as promoting producibility and yield in the casting of the turbine blade including all of its constituent parts including the fins and turbulators.

The exemplary fins 44 illustrated in FIG. 3 preferably taper more toward the airfoil tip 38 of the blade which is toward the top of FIG. 3 than toward the airfoil root 36 which is toward the bottom of FIG. 3. The upper portion of the fins has a gradual or long taper, whereas the lower portion of the fins has a sharp or short taper creating an abrupt change in elevation from the otherwise smooth inner surface of the leading edge flow channel to the target or top region of the fin.

It is noted that the turbine blade rotates during cm operation and is subject to centrifugal forces which affect the flow characteristics of the cooling air. Secondary flow effects of the spent impingement air flowing radially upwardly in the first channel will engage the relatively sharp or lower surfaces of the fins for providing enhanced tripping of the flow over the upper or shallow tapered surfaces thereof. Furthermore, this tapering of the fins also promotes the producibility and yield in casting of the airfoils.

It is noted in FIG. 2 that the profiles and curvature of the leading edge channel 32 chance from the pressure sidewall to the suction sidewall and behind the leading edge therebetween along which the fins and turbulators are located. Accordingly, the fins and turbulators have correspondingly different configurations for enhancing their heat transfer effect and promoting casting producibility of the airfoil. For example, FIG. 3 illustrates that the suction-side second turbulators 48 adjoin each other in a longitudinally extending serpentine configuration having maximum thickness or height near the fins 44 and decreasing in thickness or height along the suction sidewall toward the forward bridge.

In the preferred embodiment illustrated in FIGS. 3 and 4, the fins 44 have a generally slender triangular configuration tapering in height along the pressure sidewall to the forward bridge. The pressure-side first turbulators 46 have a generally rectangular configuration and are spaced apart from the forward bridge and respective ones of the fins 44 in general alignment with their shallow or thin ends. And, the suction-side second turbulators 48 have a collective sawtooth serpentine configuration increasing in height from the forward bridge to respective ones of the fins 44.

The differently configured fins and turbulators thusly provide cooperation therebetween for using the incident cooling air firstly in impingement cooling of the individual fins 44 and then in convection cooling as the turbulators trip the spent impingement air as it is discharged laterally through the gill holes 50. The fins and turbulators have various perimeter profiles for tripping, deflecting, and guiding the spent impingement air, and provide circuitous flowpaths for the spent air as it travels to the discharge holes.

As best illustrated in FIG. 4, each of the fins 44 is preferably aligned with a corresponding one of the impingement holes 42 in a one-to-one correspondence. In this way, each fin provides a local increase in internal surface area against which the impingement air may splash for removing heat therefrom. The spent impingement air then flows laterally from each of the fins to engage the corresponding first and second turbulators prior to discharge from the gill holes.

FIG. 3 illustrates exemplary configurations of the fins and turbulators including the relative inclinations thereof which promote enhanced heat transfer. These configurations also improve procibility and yield of the airfoils during casting manufacture. During casting, a molding die is configured with the various fins and turbulators therein for producing a corresponding ceramic core in which the fins and turbulators are represented by corresponding recesses therein.

The molding die has a parting plane generally along the vertical leading edge, illustrated in dash line in FIG. 3, along which the parts of the die must be separated to release the ceramic core formed therein. Since the protuberances of the die which define the fins and turbulators nest in the corresponding recesses formed thereby in the solidified ceramic core, the fins and turbulators must have a suitable configuration to permit parting of the die sections without damage to the core.

For example, if the leading edge flow channel included generally uniform protuberances spaced apart along the pressure and suction sidewalls, such configuration would most likely prevent unobstructed separation of corresponding molding die sections specifically configured therefor. The protuberances of the die would engage the recesses of the core on both sides of the parting plane and trap the core in the die sections. Either the die sections could not be separated from each other, or the ceramic core would be damaged by the die protuberances interfering with separation of the dies.

The castellated configuration of the fins and turbulators illustrated in the preferred embodiment of FIGS. 3 and 4 eliminates these producibility problems, while also providing enhanced cooling effectiveness of the limited amount of compressor air channeled through the turbine airfoil. The fins are specifically configured for cooperating with the corresponding impingement holes in a one-to-one correspondence for providing impingement targets for each of those holes. The pressure and suction side turbulators are laterally offset from the fins for cooperating therewith as the spent impingement air is dischargeed through the gill holes.

The ability to increase the cooling effectiveness of the limited air provided to the turbine airfoil provides increased cooling for the same amount of air, or permits a reduction in the amount of chargeable air for a given design temperature. And, the air may be firstly used to advantage for cooling the back end of the turbine airfoil with the three-pass serpentine cooling circuit and then using the air discharged therefrom for cooling the leading edge as described above.

The serpentine circuit may have any suitable configuration, and would typically include axially extending turbulators (not shown) longitudinally spaced apart from each other in the three legs thereof. Since the fins are specifically configured for cooperating with the impingement holes, it is not desirable or preferred that the impingement holes be eliminated, and the cooling flow be otherwise provided radially upwardly or downwardly through the leading edge flow channel.

Conventional turbulators require crossflow of the air thereover as the air is channeled longitudinally through the flow channel, with the turbulators extending transversely thereacross. The fins disclosed above are not considered typical turbulators since their primary function is for providing targets of increased surface area for cooperating with the impingement cooling air. The pressure and suction side turbulators disclosed above in the leading edge channel are then specifically configured for cooperating with the spent impingement air from the fins as that air is discharged laterally through the gill holes.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A turbine airfoil comprising:

a generally concave pressure sidewall integrally joined to a laterally opposite, generally convex suction sidewall at opposite leading and trailing edges, and at multiple bridges including a forward bridge spaced between said leading and trailing edges to define a serpentine flow circuit feeding a first flow channel extending behind said leading edge between a root and a longitudinally opposite tip of said airfoil;

said forward bridge including a row of impingement holes for channeling cooling air into said first channel;

said first channel including a row of fins protruding therein from the back side of said leading edge, a row of first turbulators protruding therein from said pressure sidewall, and row of second turbulators protruding therein from said suction sidewall; and said fins and first and second turbulators having different configurations for increasing internal surface area and heat transfer for back side cooling said leading edge by said cooling air.

2. An airfoil according to claim 1 wherein both said pressure and suction sidewalls include respective rows of gill holes having inlets disposed between said leading edge and forward bridge for discharging laterally said cooling air from said first channel, and said leading edge is imperforate between said gill holes.

3. An airfoil according to claim 2 wherein each of said fins includes a target aligned with a corresponding one of said impingement holes for being impingement cooled by said cooling air therefrom, and decreases in height from said target.

4. An airfoil according to claim 3 wherein said fins taper in height from said targets along said pressure sidewall to said forward bridge.

5. An airfoil according to claim 4 wherein said fins taper more toward said airfoil tip than toward said airfoil root.

6. An airfoil according to claim 5 wherein:

said fins have triangular configurations tapering in height along said pressure sidewall to said forward bridge;

said first turbulators have rectangular configurations and are spaced from said forward bridge and respective ones of said fins; and said second turbulators have a sawtooth configuration increasing in height from said forward bridge to respective ones of said fins.

7. An airfoil according to claim 6 wherein said first and second turbulators are longitudinally offset from respective ones of said fins.

8. An airfoil according to claim 6 wherein said first and second turbulators are laterally offset from respective ones of said fins.

9. An airfoil according to claim 6 wherein each of said fins is inclined downwardly from said target thereof toward said root and forward bridge along said pressure sidewall.

10. An airfoil according to claim 6 wherein each of said fins is aligned with a corresponding one of said impingement holes in a one-to-one correspondence.

11. A turbine airfoil comprising:

a generally concave pressure sidewall integrally joined to a laterally opposite, generally convex suction sidewall at opposite leading and trailing edges, and at a forward bridge spaced behind said leading edge to define a first flow channel extending between a root and a longitudinally opposite tip of said airfoil;

said forward bridge including a row of impingement holes for channeling cooling air into said first channel;

said first channel including a row of fins protruding therein from the back side of said leading edge, a row of first turbulators protruding therein from said pressure sidewall, and row of second turbulators protruding therein from said suction sidewall; and said fins and first and second turbulators having different configurations for increasing internal surface area and heat transfer for back side cooling said leading edge by said cooling air.

12. An airfoil according to claim 11 wherein both said pressure and suction sidewalls include respective rows of gill holes having inlets disposed between said leading edge and forward bridge for discharging laterally said cooling air from said first channel.

13. An airfoil according to claim 12 wherein each of said fins includes a target aligned with a corresponding one of said impingement holes for being impingement cooled by said cooling air therefrom, and decreases in height from said target.

14. An airfoil according to claim 13 wherein said first and second turbulators are longitudinally offset from respective ones of said fins.

15. An airfoil according to claim 13 wherein said first and second turbulators are laterally offset from respective ones of said fins.

16. An airfoil according to claim 13 wherein said fins and first and second turbulators have different inclinations longitudinally.

17. An airfoil according to claim 13 wherein said fins taper in height from said targets along said pressure sidewall to said forward bridge.

18. An airfoil according to claim 13 wherein said fins taper more toward said airfoil tip than toward said airfoil root.

19. An airfoil according to claim 13 wherein said second turbulators adjoin each other in a longitudinally extending serpentine configuration.

20. An airfoil according to claim 13 wherein:

said fins have triangular configurations tapering in height along said pressure sidewall to said forward bridge;

said first turbulators have rectangular configurations and are spaced from said forward bridge and respective ones of said fins; and said second turbulators have a sawtooth configuration increasing in height from said forward bridge to respective ones of said fins.

* * * * *